United States Patent [19]

Otting

[11] 4,341,098

[45] Jul. 27, 1982

[54] JET PATTERN DYEING OF MATERIAL, PARTICULARLY CARPET

[75] Inventor: Billy J. Otting, La Fayette, Ga.

[73] Assignee: Otting Machine Company, Inc., La Fayette, Ga.

[21] Appl. No.: 237,577

[22] Filed: Feb. 24, 1981

Related U.S. Application Data

[63] Continuation of Ser. No. 85,943, Oct. 18, 1979, abandoned.

[51] Int. Cl.[3] ..... D06B 1/02; D06B 11/00

[52] U.S. Cl. ..... 68/205 R; 239/551; 251/7

[58] Field of Search ..... 68/205 R; 118/684; 239/551, 562, 567; 251/5, 6, 7

[56] References Cited

U.S. PATENT DOCUMENTS

| | | | |
|---|---|---|---|
| 1,427,455 | 8/1922 | Gates | 251/7 X |
| 1,677,453 | 7/1928 | Jones | 251/7 X |
| 1,873,000 | 8/1932 | McCarthy | 428/195 |
| 2,128,585 | 8/1938 | Hannay et al. | 251/7 X |
| 2,660,395 | 11/1953 | Mair et al. | 251/7 X |
| 2,804,764 | 9/1957 | Runton | 68/205 R X |
| 3,393,411 | 7/1968 | McElveen | 68/205 R X |
| 3,443,878 | 5/1969 | Weber et al. | 68/205 R X |
| 3,570,275 | 3/1971 | Weber et al. | 68/205 R |
| 3,793,785 | 2/1974 | Austin | 251/7 |
| 3,921,670 | 11/1975 | Clippard, Jr. et al. | 137/625.65 |
| 3,969,779 | 7/1976 | Stewart, Jr. | 68/205 R X |
| 3,982,724 | 9/1976 | Citrin | 251/7 |
| 3,985,006 | 10/1976 | Klein | 68/205 R |
| 4,033,154 | 7/1977 | Johnson | 68/205 R |
| 4,044,989 | 8/1977 | Basel et al. | 251/7 |
| 4,058,146 | 11/1977 | Citrin | 251/7 X |
| 4,112,531 | 9/1978 | Mitter | 8/149 |
| 4,116,626 | 9/1978 | Varner | 68/205 R X |
| 4,141,231 | 2/1979 | Kudlich | 68/205 R |
| 4,157,149 | 6/1979 | Moen | 68/205 R X |
| 4,181,121 | 1/1980 | Schwoboda et al. | 251/7 X |

FOREIGN PATENT DOCUMENTS 2009257 9/1971 Fed. Rep. of Germany .

OTHER PUBLICATIONS

Godfrey Hirst Australia Pty, Ltd., "The Merits of Carpet Coloring Computers", *Textile Industries*, Mar. 1979, pp. 78–82.

Suchecki, "Carpet Coloring Technology: A Strong Outlook", *Textile Industries*, May 1979, pp. 50–60.

Richardson, "Rotaries Producing Carpeting's Hottest Look", *Textile World*, May 1979, pp. 84–90.

Dawson and Roberts, "Dyeing and Printing Methods for the Coloration of Carpet Yarns and Carpet Piece by Jet-Impregnating Methods", *JSDC*, Dec. 1977, pp. 439–447.

Ward, "Tufters 'Will Not Be Excluded From Economical Jet Printing'", *Textile Month*, Dec. 1977.

Dawson, "An Assessment of New Printing Methods for Carpets", *Textile Institute and Industry*, Jan. 1978, pp. 16–18.

Seidel, "Aussie Carpet Jet Printer", *Textile Industries*, Feb. 1978, pp. 73–75.

Klapper, "Jet Dot Printing: High Speed Fashion", *Women's Wear Daily*, Jun. 25, 1974.

Zimmer, "A New Carpet Patterning Unit", *Carpet and Rug Industry*, Jan. 1977, pp. 8–9.

Stoyel, "Carpet Printing: The Different Systems Now in Operation", *Textile Institute and Industry*, Jan. 1977, pp. 25–27.

Abramson, "Comparing Recently Developed Carpet Printing Systems", *Carpet and Rug Industry*, Jun. 1977, pp. 26–32.

*Primary Examiner*—Philip R. Coe

*Attorney, Agent, or Firm*—Kerkam, Stowell, Kondracki & Clarke

[57] ABSTRACT

High performance apparatus for pattern dyeing of textile material by means of a plurality of controlled liquid dye streams. The textile material is conveyed in web form beneath one or more applicators each including a plurality of closely spaced nozzle tubes extending across the textile web. A dye source supplies dye under pressure through flexible tube portions to the nozzle tubes, the flexible tube portions permitting pinching for selective control of dye flow. For rapid and precise control of liquid dye streams, pinch tube valve assemblies are provided for each flexible tube portion for which control of dye flow is desired. A superior and effective pinch tube valve assembly is of the type generally including a valve block portion with a bore in the valve block portion receiving the corresponding dye delivery tube flexible portion. A passageway in the valve block portion communicates with and is disposed generally transversely to the bore, and a tube pinch off member is selectively reciprocal within the passageway into the bore for forcing the corresponding dye delivery tube closed. An actuator is provided for selectively urging the tube pinch off member against the corresponding dye delivery tube. A suitable controller causes selective actuation of the pinch tube valve assemblies as the textile material moves relative to the dye delivery tube outlet ends to effect dyeing of the textile material in a desired pattern. A variety of nozzle tube arrangements may be employed for various control and pattern effects.

21 Claims, 14 Drawing Figures

FIG. 5.
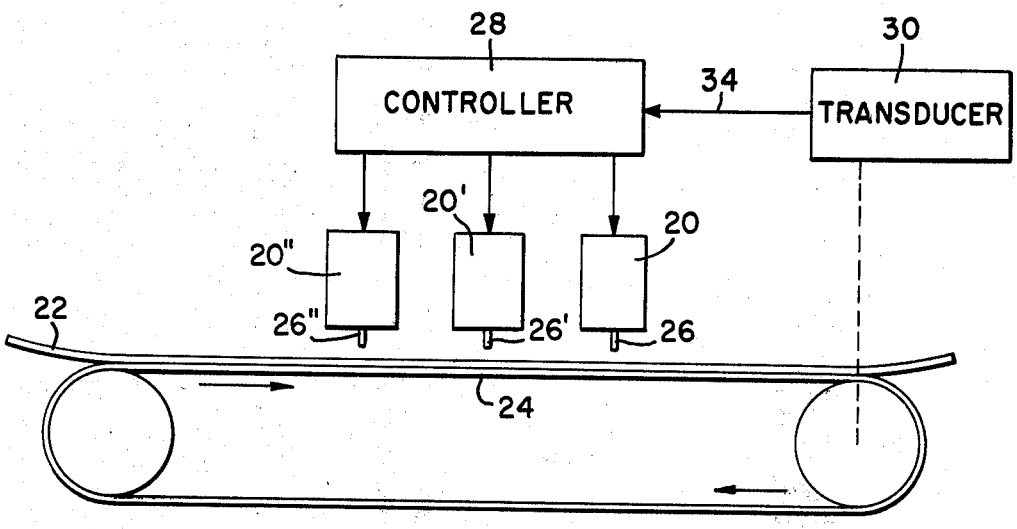
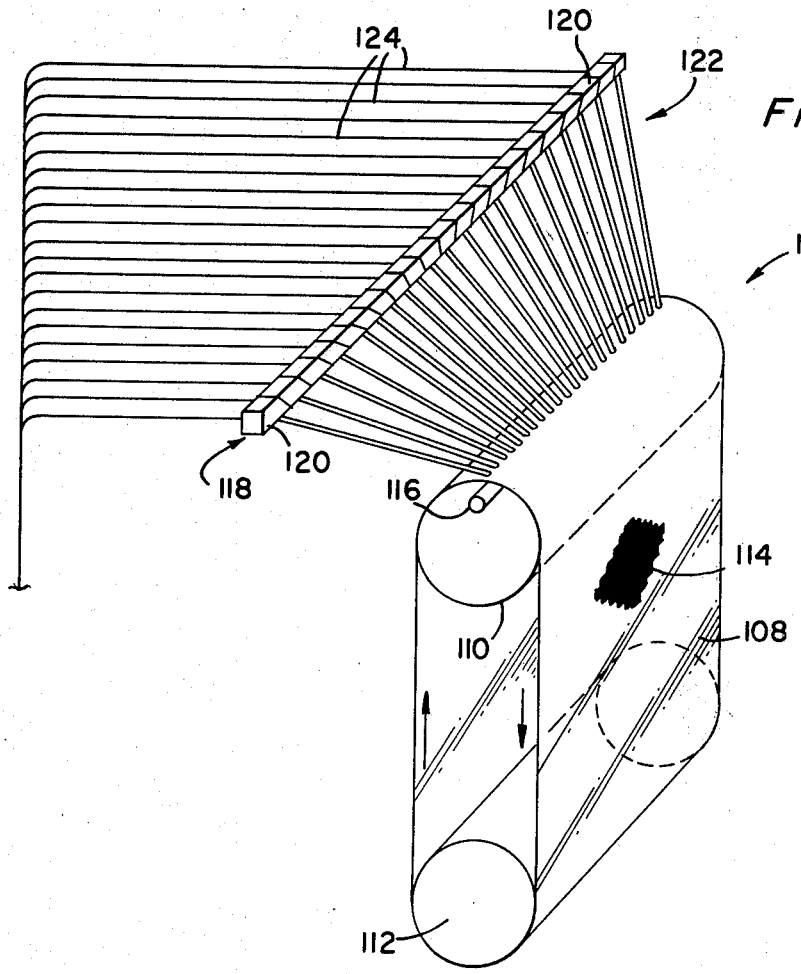
FIG. 10.

JET PATTERN DYEING OF MATERIAL, PARTICULARLY CARPET

This application is a continuation of application Ser. No. 85,943, filed Oct. 18, 1979, and now abandoned.

CROSS-REFERENCE TO RELATED APPLICATION

Valve arrangements described herein are more particularly described and claimed in application Ser. No. 86,392, filed Oct. 18, 1979, concurrently herewith by Billy Joe Otting, and entitled PINCH TUBE VALVE.

BACKGROUND OF THE INVENTION

The present invention relates generally to pattern dyeing of sheet or textile material, for example carpet. More particularly, the invention relates to pattern dyeing of textile material by means of a plurality of controlled liquid dye streams.

The printing of such textile webs, particularly carpets, is well known in the art, and is carried out by a variety of techniques. At the present time most carpet printing is done by techniques more or less analogous to conventional printing techniques, such as rotary printing and screen printing. The use of such traditional carpet printing techniques requires an individual roller or screen for each color of each individual pattern which it may be desired to print. These rollers or screens are typically twelve or fifteen feet wide, and involve great expense both in initial manufacture and in storage.

As an attractive alternative to traditional carpet printing techniques, there is a great deal of interest in controlled dye jet printing of textile materials, particularly carpet, and a number of such machines have been produced. In such machines, plural colored dyes are sprayed or jetted onto the surface of moving textile material. Alternatively, dye jets may move over the surface of a stationary carpet web, with the carpet web intermittently advancing in large increments as is done in traditional screen printing. Generally, such jet printing machines comprise a plurality of dye applicators extending across the path of carpet travel. Each dye applicator comprises a multiplicity of dye outlet tubes or nozzles extending in a line along the applicator traverse to the direction of carpet travel, with the nozzles of each of the applicators being supplied with a different color. Each individual nozzle or jet is controllably activated by suitable electronic, pneumatic or mechanical means to dispense dyes onto the moving textile material under control of a suitable pattern controller. The pattern controller may take any one of various forms. Examples are mechanically, electrically or optically sensed rotating drums or endless webs, coded punch cards, coded magnetic tapes, and various forms of computer based controllers employing high speed random access memories.

A crucial element in such a jet dyeing machine is the means for individually controlling the multiplicity of closely spaced dye streams in a rapid and precise manner. The quality of the finished product, as well as the speed of carpet printing, depend primarily upon the quality of the control means for the individual dye streams. A number of approaches have been previously proposed.

An early example of a jet printing apparatus is disclosed in the McCarthy U.S. Pat. No. 1,873,000 and employs a plurality of magnetically actuated air brushes electrically controlled by a rotating drum having a pattern of insulative and noninsulative areas on the surface thereof which electrical pickup brushes variously contact as the drum rotates, thereby to control individual air brushes in a desired manner.

The Runton U.S. Pat. No. 2,804,764 and the McElveen U.S. Pat. No. 3,393,411 provide examples of fabric printing machines wherein individual solenoid valves are used to selectively and individually control the supply of dye to a plurality of spray nozzles or dye delivery tubes.

The above noted McElveen U.S. Pat. No. 3,393,411 mentions, as an alternative, that portions of the dye delivery tubes may comprise flexible portions, with one or more pinching bars employed to control the flow of dye through the dye delivery tubes.

In another approach, as represented by the Kudlich U.S. Pat. No. 4,141,231, individual electromagnetically operated needle valves control the application of dye to a moving textile web so as to effectively print a pattern thereon. The Moen U.S. Pat. No. 4,157,149 discloses an air pressure operated valve having a similar seating arrangement for the controlled pattern application of fluids such as glue.

A related system, but which does not employ controlled dye streams at all, is disclosed in the Mitter U.S. Pat. No. 4,112,531. In the Mitter system, a plurality of individual mechanically movable dot printing elements actually physically contact the carpet at appropriate points under program control.

Lastly, another particular system for the selective control of dye streams for the purpose of printing carpet employs a plurality of continuously flowing dye streams which are selectively deflected by a stream of air (or by a mechanical deflector) either to permit impingement of the dye stream on a moving inclined web of fabric or carpet, or to cause recirculation of the dye stream to a dye supply reservoir. Although this particular system is fairly complex and expensive, it is in commercial use. This well illustrates the problems involved in the precise control of plural dye streams for carpet dyeing with acceptable response speeds, and the lengths to which the prior art has gone to achieve operation. A large number of patents, as well as publications in the literature, provide details of such systems, and the following are identified merely by way of representative example: Weber et al U.S. Pat. No. 3,443,878; Weber et al U.S. Pat. No. 3,570,275; Stewart, Jr. U.S. Pat. No. 3,969,779; Kline U.S. Pat. No. 3,985,006; Johnson U.S. Pat. No. 4,033,154; and Varner U.S. Pat. No. 4,116,626.

From the above, it will be apparent that rapid and precise selective control of plural dye streams for textile pattern dyeing is a more difficult problem than might appear at first glance. Conventional commercially available solenoid type liquid control valves simply are not adequate. Among the performance requirements for such a dye control system is extreme speed of response to permit precise control of relatively small amounts of dye to form a complex pattern on a textile web moving from twenty to fifty feet per minute, or more. Additionally, the valve and nozzle assembly must be substantially drip free to avoid any unwanted depositing of colored dye on the wrong areas of a carpet pattern. In this connection, it should be noted that in several known prior art systems, to prevent dripping, relatively high viscosity dyes and relatively small nozzles are employed. A drawback to such an approach is that the use of a high viscosity dye requires relatively more dye pressure, up to for example 140 p.s.i., in order to effectively penetrate carpet.

The benefits to be realized through the use of a successful dye jet carpet printing machine are numerous and substantial. For one, the potential speed of printing is far in excess of traditional carpet printing techniques. For example, conventional roller printing techniques are generally limited to 45 feet per minute, and conventional screen printing techniques are generally limited to 20 feet per minute.

Additionally, a dye jet carpet printing machine completely eliminates the necessity to fabricate and store bulky printing rollers or screens. Pattern information can be stored on relatively compact media such as miniaturized drums, photoelectrically sensed drums or webs, magnetic tape, and the like.

A further benefit is the potential ease with which such systems may be programmed for the purpose of printing full sized samples of proposed patterns. Using conventional electronic digital programming techniques, for example employing a CRT display of individual pattern elements with a corresponding keyboard or digitizer tablet data entry device, a pattern designer may in a single day investigate the esthetic qualities of a number of completely different carpet patterns. Such rapid sample production is not possible as a practical matter using conventional printing techniques which require the fabrication of rollers or screens.

SUMMARY OF THE INVENTION

Accordingly, it is an object of the invention to provide practical and highly effective apparatus for pattern dyeing of sheet or textile material with liquid dye streams.

It is another object of the invention to provide such apparatus at much lower cost and complexity than heretofore thought possible, but with superior results.

It is still another object of the invention to provide such apparatus which does not require relatively viscous dyes for the purpose of enhancing capillary action to prevent dripping.

It is still another object of the invention to avoid the consumption of large amounts of energy such as are required to deflect moving dye streams from carpet and into a reservoir by means of air jets.

It is still another object of the invention to provide such pattern dyeing apparatus which can direct dye streams towards carpet in any desired orientation, including vertically straight down, thereby allowing the use of horizontal (rather than inclined) conveyers, which in turn permits the use of relatively low viscosity dye with minimal possibility of running during the first few critical seconds during which the dye is penetrating the carpet.

It is still another object of the invention to provide such pattern dyeing apparatus which includes straightforward on/off valving of liquid dye supplied to dye outlet nozzles or jets without requiring continuous recirculation of liquid dye from the nozzles into a reservoir with attendant potential dye contamination problems, and avoiding turbulance caused by air impinging on a dye stream tending to break it up into droplets.

It is yet another object of the invention to provide a textile pattern dyeing apparatus including an improved valve arrangement permitting rapid and precise control of liquid dye streams, with substantially no dripping from a particular nozzle when the supply of dye thereto is cutoff.

Briefly stated, and in accordance with one aspect of the invention, apparatus for pattern dyeing of sheet or textile material with liquid dye streams includes a support, such as a moving conveyer belt, for the textile material, and a plurality of dye delivery tubes comprising one or more applicators, the dye delivery tubes having spaced outlet ends in the form of nozzle tubes directed towards the textile material. The dye delivery tube outlet ends and the textile material are relatively movable with respect to each other, this preferably being accomplished by holding the applicator and dye delivery tubes stationary while the carpet material is conveyed therebeneath. A dye source supplies dye under pressure to inlet ends of the dye delivery tubes, and the dye delivery tubes have at least portions which are flexible to permit pinching for selective control of dye flow.

An important feature of the present textile printing apparatus is the valve assembly which provides the requisite precise and rapid control of liquid dye streams. For this purpose, pinch tube valve assemblies are provided for each of the dye delivery tube flexible portions for which control of dye flow is desired. In accordance with the invention, it has been discovered that a superior and effective pinch tube valve assembly is of the type generally including a valve block portion with a bore in the valve block portion receiving the corresponding dye delivery tube flexible portion. A passageway in the valve block portion communicates with and is disposed generally transversely to the bore, and a tube pinch off member is selectively reciprocal within the passageway into the bore for forcing the corresponding dye delivery tube closed. An actuator is provided for selectively urging the tube pinch off member against the corresponding dye delivery tube.

To complete the textile pattern dyeing apparatus, a suitable controller is provided for causing selective actuation of the pinch tube valve assemblies as the textile material moves relative to the dye delivery tube outlet ends to effect dyeing of the textile material in a desired pattern. As mentioned above, there are a variety of controller types which are suitable for such applications, the only particular requirements being a fairly high rate of relatively error free pattern information output, with separate control outputs being provided for each controlled nozzle or group of nozzles of each color.

Within the pinch tube valve assemblies, the valve actuators each preferably comprise a pneumatically operated piston, and the pattern dyeing apparatus further includes a plurality of valves controlled by the controller to selectively supply air or other gas under pressure to actuate the pistons for pinching closed the dye delivery tube flexible portions. The valves controlled by the controller are preferably electrically operated valves responsive to electrical signals output by the controller.

It is highly preferable that within each of the pinch tube valve assemblies the intersection of the bore and the generally transverse passageway defines a pinch chamber having a flat bottom in the wall of the bore directly opposite the tube pinch off member. In accordance with another aspect of the invention, each of the tube pinch off members comprises a piston rod with a freely floating ball disposed between the end of the piston rod and the corresponding dye delivery tube flexible portion. Further, the communicating passageway has a larger diameter than the bore which receives the flexible tube portion.

With this particular arrangement, the flat bottom and enlarged pinch chamber allow the tube to be pinched flat, without crimping on the sides. Further, the freely-floating ball allows a self-aligning action within the flat chamber.

The dye delivery tube outlet ends are physically arranged into at least one generally linearly extending group comprising an applicator, with the apparatus comprising a plurality of dye delivery tube outlet end groups comprising a corresponding plurality of applicators spaced along the direction of travel of the conveyer, the dye delivery tube outlet groups being supplied with dyes of different colors.

In accordance with the invention, it has been discovered that such pinch tube valves are surprisingly effective and advantageous when employed in a carpet dyeing machine. Not only is the operation fast and precise, but relatively trouble-free, with straightforward maintenance procedures when needed. One particular control attribute, previously mentioned, is substantially complete freedom from dripping, even with relatively large diameter nozzle tubes and low viscosity dye. In operation, it can be observed that, when a particular dye stream is cut off, the end of the column of liquid dye within the dye delivery tube actually retracts somewhat (e.g, ¼ inch) from the actual end of the nozzle tube, positively precluding any possibility of a hanging droplet.

This highly advantageous phenomenon is presently believed to be at least in part due to several factors. First, a pinch tube valve inherently does not permit the introduction of any air whatsoever into the tube at the moment of valve closure. Not all valves share this characteristic. For example, sliding spool valves may not. Second, due to the extreme speed of valve response, particularly closure, a momentary vacuum is believed to result immediately downstream of each valve at the moment of valve closure as a column of dye traveling through a dye delivery tube tends to continue flowing by virtue of its own momentum. When the column of dye finally does stop moving or flowing, it reverses direction for a short distance as the head end of the column is drawn back up by the vacuum thus created, and the outlet end of the dye column correspondingly retracts from the end of the nozzle tube.

In accordance with other aspects of the invention, a variety of nozzle tube arrangements may be employed for various control and pattern effects. As one example, for uniform dyeing without missing strips of carpet between nozzle tubes, it is desirable to employ 0.10 inch nozzle spacing. With ten nozzle tubes per inch, 1,440 nozzle tubes are required for a twelve foot applicator. However, with many patterns a five per inch (0.20 inch spacing) resolution is quite acceptable. Taking advantage of this, nozzle tubes may be supplied in adjacent pairs through "Y" branch connections downstream of the pinch tube valves. Thus the number of control valves required per applicator, as well as the number of distinct controller output points, may be halved. Instead of 1,440, only 720 would be required.

It is known in the art that where a pattern repeats a plurality of times across the width of the carpet web, the nozzle tubes may be grouped into identically actuated groups. Each nozzle of one group producing one pattern repeat corresponds to a nozzle of at least one other group producing another pattern repeat. With a six foot repeat, the number of control valves and controller output points per applicator may again be halved, to 360.

As another example of a nozzle tube arrangement, a plurality of different dyes may be supplied to a single applicator, and connected to individual nozzle tubes in various interleaving arrangements. By way of more specific example, two different dyes (differing in color, pressure and/or viscosity) may be supplied to the nozzle tubes of a single applicator in an interleaved fashion. Every other nozzle tube is supplied with one dye, and the remaining nozzle tubes supplied with the other dye. Alternatively, the nozzle tubes may be grouped in pairs as described above (or in even larger groups) and the pairs interleaved and supplied with two different dyes. As another alternative, carrying this arrangement to an extreme, each nozzle tube in an applicator may be supplied with an individual dye.

The present invention therefore provides high performance pattern dyeing apparatus having a number of important advantages. First and foremost is extremely fast, accurate and precise control of dye application, with a high degree of equipment reliability. Further, low viscosity dyes may be employed (having viscosities even as low as that of water) without dripping, even with relatively large diameter nozzle tubes (e.g., 0.070 inch I.D.). The use of low viscosity dye allows thorough penetration into carpet pile material, with relatively low dye pressure (e.g., twenty to thirty p.s.i., up to a maximum of sixty p.s.i.). This is in contrast to prior art systems employing small diameter nozzle tubes and relatively viscous dye to prevent dripping, and as a result requiring high dye pressure (e.g., up to 140 p.s.i.).

Another important advantage is that the carpet being dyed may be horizontal, with the dye stream flowing vertically straight down. This minimizes running, even with advantageously employed low viscosity dyes. Horizontal carpet positioning is particularly important during the first few seconds the dye is penetrating the carpet.

Other significant advantages are: low energy consumption as little power is required for dye stream control purposes; and conventional valving action in nozzle tube supply lines avoiding the need for a dye stream deflection system with its attendant turbulance, critically close spacing between deflected dye stream and carpet, requirement of an inclined carpet web, and need to recirculate dye after leaving the nozzles with the possibility of contamination.

Another advantage is that a relatively compact applicator can be constructed, with all valves located near the nozzle tubes and connected to the nozzle tubes by relatively short lengths of tubing (e.g., nine inches). Short tubing runs downstream of the valves are a factor in the overall high response speed and precision of the apparatus.

Still another advantage is proven long life of valve assemblies, and with easy repairability in the event of a failure.

While the present invention was developed primarily as a pattern dyeing machine, it will be appreciated that its uses are not so limited as the ability to control individual dye stream leads to the ability to produce other effects. As one example, the dye stream control valves may be individually supplied with random or pseudo-random control signals generated by a suitable controller, with corresponding random or apparently random patterns of carpet dyeing. As another example, all of the dye streams from a single applicator may be supplied with a single dye color and allowed to flow continuously and simultaneously to effect simple continuous single color dyeing. This may be the finished color of the carpet, or may be a light background shade followed by other applicators operating with pattern or random control. Similarly, dyes of different viscosities may be continuously applied by means of a plurality of applicators resulting in various degrees of dye penetration. Such techniques can produce tip dyeing of the individual carpet strands.

BRIEF DESCRIPTION OF THE DRAWINGS

While the novel features of the invention are set forth with particularity in the appended claims, the invention, both as to organization and content, will be better understood and appreciated, along with other aspects and features thereof, from the following detailed description, taken in conjunction with the drawings, in which:

FIG. 5 is a highly schematic illustration of three applicators positioned above a carpet conveyer;

FIG. 10 is a highly schematic depiction of one form of controller suitable for use in carpet dyeing apparatus of the present invention;

DETAILED DESCRIPTION OF THE PREFERRED EMBODIMENTS

Figure 1:
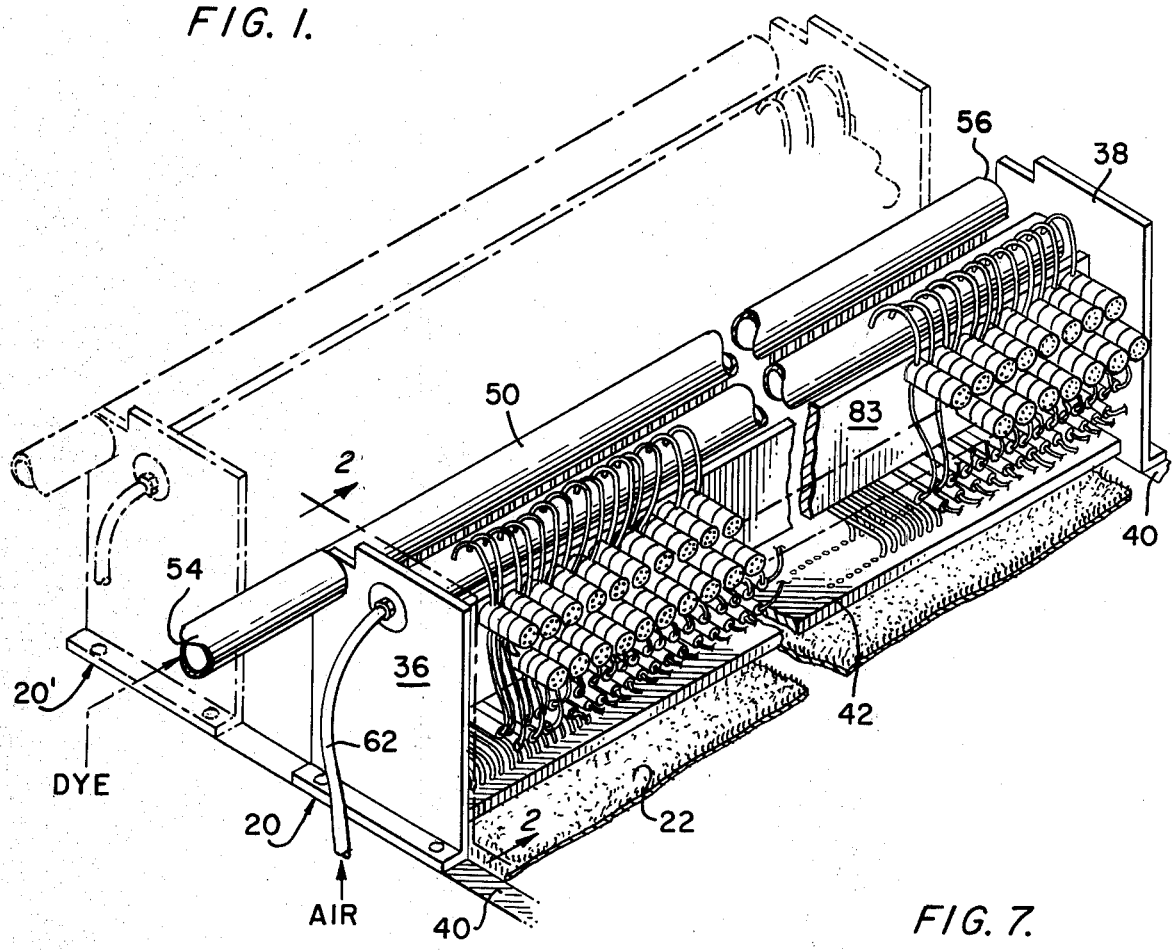
FIG. 1 is an isometric view of one form of applicator shown in solid lines with a portion of textile material passing therebeneath, and a partial illustration of a second applicator shown in phantom lines.

Referring now to FIGS. 1–5, one form of applicator of a pattern dyeing apparatus in accordance with the invention is generally designated 20. Also shown in phantom lines in FIG. 1 is a second applicator designated 20'. The applicators such as the applicator 20 extend across a moving web of textile material, shown as carpet 22, which is pattern dyed by the apparatus. As may be seen in FIG. 5, the carpet 22 being dyed is supported and carried by a conveyor 24 past a plurality of applicators 20, 20' and 20''. Shown in FIG. 5 are representative dye delivery tube outlet ends 26, 26' and 26''. It will be appreciated that each of the dye delivery tube outlet ends 26, 26' and 26'' is representative of a multiplicity of dye delivery tube outlet ends included in each of the applicators 20, 20' and 20'', arranged either in linearly extending rows or staggered rows. As is known in the art, a suitable controller 28 is provided, and may be arranged to individually control each dye delivery tube or to individually control separate groups of dye delivery tubes to effect dyeing of the carpet 22 in a desired pattern. Typically, each of the applicators 20, 20' and 20'' is supplied with dye of a different color. Although only three applicators 20, 20' and 20'' are illustrated, there is no particular significance to the precise number employed, and eight or more may be employed for particular multicolored patterns.

Although not illustrated in FIG. 5, it will be appreciated that a conventional steam chamber may be provided to fix the dyes, as well as other conventional devices such as washers for excess dye and dryers.

For the controller 28 to accurately cause a pattern to be produced along the length of the moving carpet web 22, it is necessary for the controller 28 to have accurate information concerning the speed and thus the position of the carpet 22 at all times. For this purpose, a transducer 30 is coupled to the drive system for the conveyor 24, as shown by representative connection line 32, and communicates positional and/or velocity information to the controller 28 via a line 34. The transducer 30 may taken any one of several forms dependent upon the particular requirements of the controller 28, and preferably is a pulse type transducer employing a photoelectric light chopper disk, also known as an optical encoder, or the like to output a single pulse on the line 34 for each predetermined increment of conveyor 24 and thus carpet 22 travel. As an example, the transducer 30 may output a pulse along the line 34 for every 0.1 inch of conveyer 24 and carpet 22 travel. Other types of transducer 30 may also be employed, such as synchro selsyns, or simple generator type tachometers.

It will be appreciated that there are a number of reasons why the controller 28 must have accurate positional and velocity information. One reason is that pattern distortion along the length of the carpet might otherwise occur. For example, circles comprising a part of the pattern design might otherwise be longitudinally either lengthened or foreshortened into elipses. A second reason is that with separate applicators, 20, 20' and 20'' having dye delivery tube outlets 26, 26' and 26'' spaced along the moving carpet web 22, a definite delay or transportation lag must be taken into account in order that application of different colored portions of the pattern be precisely coordinated with one another.

Similarly, the dye delivery tube outlet ends of a single applicator such as the applicator 20, 20' or 20'' may be arranged in staggered rows for the purpose of obtaining an effective relatively close outlet end spacing, and a transportation lag delay introduced thereby must also be taken into account.

Referring now to FIGS. 1–4 in greater detail, the representative applicator 20 comprises left and right upstanding frame side members 36 and 38 fixedly mounted to a bed support 40, with a dye delivery nozzle tube support member 42 comprising a flat plate 42 disposed in a horizontal position extending across the applicator 20 near the lower end thereof.

Carried by the dye delivery tube support member 42 are a plurality of dye delivery tube outlet ends 44 (FIGS. 2 and 3), which may be generally compared to the dye delivery tube outlet ends 26, 26' and 26'' of FIG. 5. As may be seen from FIGS. 1, 2 and 4, the dye delivery tube outlet ends 44 comprise nozzle tubes, and are arranged in two staggered rows in this particular embodiment in order to obtain an effectively close spacing across the width of the carpet with a particular nozzle diameter. It will be appreciated, however, that the dye nozzle tubes 44 may equally as well be arranged in a single row for each applicator.

In the particular embodiment illustrated, the effective nozzle tube 44 spacing across the width of the carpet is ten per inch (0.10 inch centers). However, to achieve this, the nozzle tubes 44 are arranged in staggered rows 46 and 48, with the nozzle tube spacing in each of the rows 46 and 48 being five per inch (0.20 inch centers), and the rows 46 and 48 being spaced for example, two inches apart. The diameter of the nozzle tubes 44 is not critical, and I.D.'s of 0.048, 0.060 and 0.070 inch have all been successfully employed. The tube 44 may be formed of stainless steel.

A dye source comprises a tubular dye manifold 50 into which dye 52 (FIG. 2) is introduced under pressure from a reservoir (not shown). Preferably to keep the dye solution uniformly mixed, a recirculation system is employed wherein dye is continuously pumped from a vat-like reservoir into the end 54 of the dye manifold 50 and out the other end 56 of the dye manifold 50 through a pressure regulating valve arrangement, to be returned to the vat or reservoir. It will be appreciated that this dye recirculation arrangement does not involve the dye delivery nozzles 44 in any way, thereby minimizing any possibility of dye contamination. Typical dye pressure within the manifold 50 is twenty to thirty p.s.i., although it may be as high as sixty p.s.i.

The applicator 20 also includes a tubular air manifold 58 into which air 60 (FIG. 2) or other gas is introduced under pressure via a line 62 from an external compressor (not shown). Suitable pressure within the air manifold 58 is 80 p.s.i. A particular feature of the applicator 20, and particularly the valves thereof, is that a large volume of air is not required to operate the valves (described below) and therefore the external compressor can be of relatively small capacity, for example ten horsepower for a full scale eight applicator system, and thus consume relatively little energy.

Extending from the dye manifold 50 to the dye delivery tube outlet ends 44 are dye delivery tube flexible portions 64 (best seen in FIG. 2), the flexibility permitting pinching for selective control of dye flow.

The dye delivery tube flexible portions 64 each pass through a pinch tube valve assembly 66 within which a tube pinch off member is selectively urged against each corresponding dye delivery tube to effect control over dye flow therethrough, as is described in greater detail below with particular reference to FIGS. 6–9. There is a pinch tube valve assembly 66 for each of the dye delivery tube flexible portions 64 for which control is desired. It will be appreciated that a plurality of dye delivery tube outlet ends 44 may be supplied through a single valve assembly for simultaneous control. For example, as is known in the art, a particular pattern may repeat several times across the width of the carpet, such that the individual dye applicator nozzles 44 are controlled in identical groups corresponding to the pattern repeat. For economy both in valves and in control capability, individual supply tubes may be run to a plurality of widely spaced nozzles by means of "Y" branch connectors for control from a single valve. Additionally, as is described in greater detail below with particular reference to FIG. 14, in accordance with the invention a plurality of adjacent dye delivery tube outlet ends 44 may be simultaneously controlled through a single valve.

The precise length of that portion of each of the tube flexible portions 64 which is downstream of the respective valve assembly 66 (i.e., between the valve assembly 66 and the nozzle tube 44) is not especially critical, and may range from nine to eighteen inches, or even more, depending upon the physical size and particular arrangement selected. However, to avoid loss of synchronization which might otherwise occur as a result of different speeds of response, it is important that all of the tube 64 in the entire system have the same length downstream of the valve assemblies. In the case of "Y" branches, the relevant distance is from the common valve assembly 66 to each individual nozzle tube 44.

Figure 2:
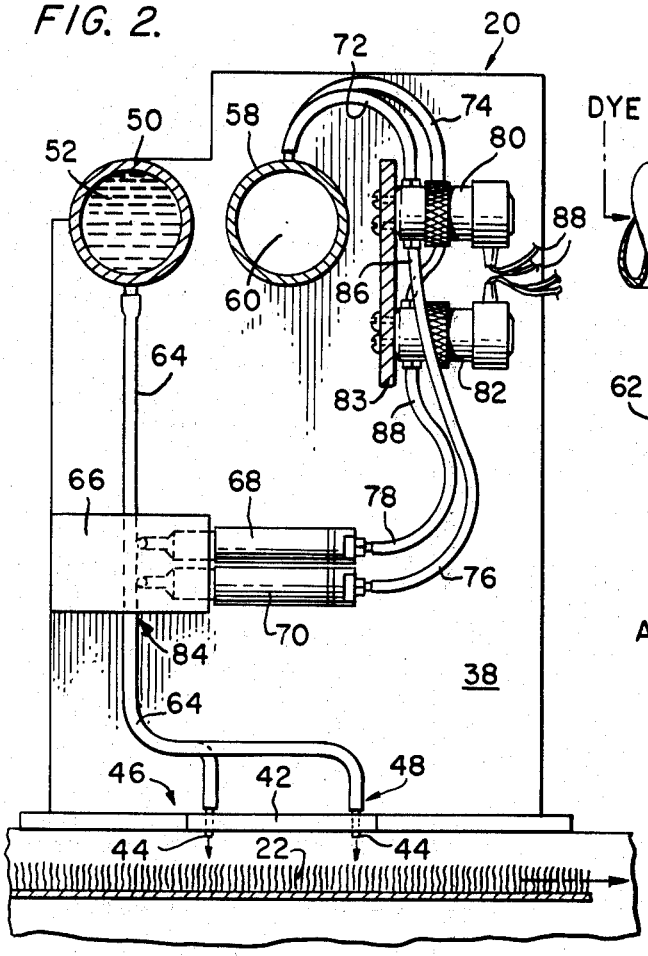
FIG. 2 is a section taken along line 2—2 of FIG. 1 showing details of one of the FIG. 1 applicators.
Figure 3:
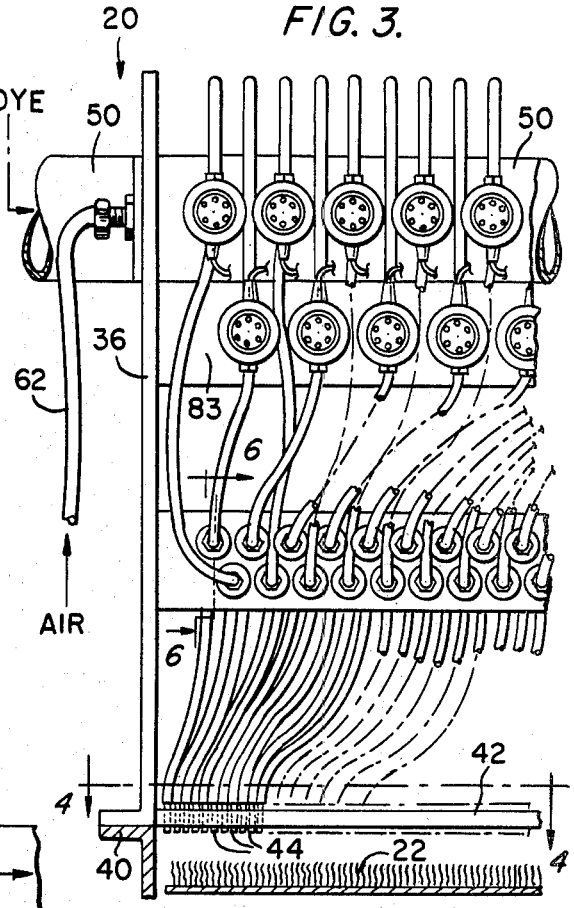
FIG. 3 is a front elevational view of an applicator of FIG. 1 showing additional details thereof.
Figure 4:
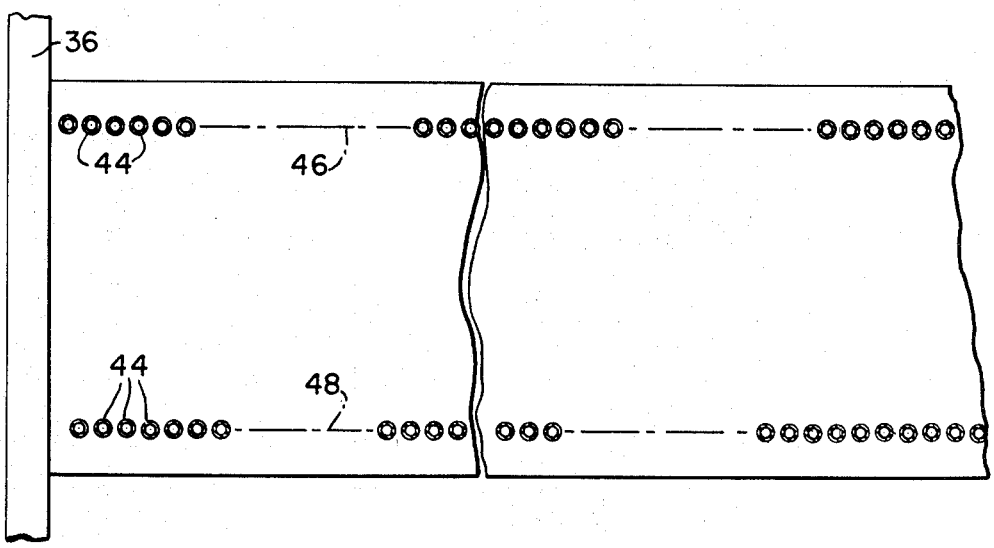
FIG. 4 is a plan view taken along line 4—4 of FIG. 3 showing the manner in which dye outlet tubes may be slightly staggered in the direction of carpet travel for the purpose of increasing the density of dye applicator nozzles in a direction across the path of carpet travel.

Each of the valve assemblies 66 comprises a pneumatic actuator, such as the actuators 68 and 70 shown in FIG. 2, supplied via tubes 72, 74, 76 and 78 from the air manifold 58 under the control of electromagnetically operated miniature valves 80 and 82 mounted on a support plate 83. By way of example only, and without in any way limiting the scope of the invention, the air valves 80 and 82 may comprise model EV-3 Clippard Minimatic® electronic/pneumatic valves, manufactured by the Clippard Instrument Company of Cincinnati, Oh., which are believed to be substantially similar to the valve disclosed in the Clippard, Jr. et al U.S. Pat. No. 3,921,670. The pneumatic actuators 68 and 70 may be any standard actuator, such as those manufactured by the Bimba Manufacturing Company.

In the general operation of the valving arrangement as thus far described, whenever a representative air valve 80 (FIG. 2) is de-energized, air pressure within the manifold 58 is blocked by the valve 80. Thus the tube 76 is not supplied with air pressure, and the piston rod 84 of the pneumatic actuator 70 is retracted, allowing dye 52 to freely flow from the dye manifold 50 through the tube flexible portion 54 for supplying one or more of the dye delivery tube outlet ends 44. It should be noted that the particular valves 80 and 82 employed have a characteristic such that the outlet ports 84 and 86 are vented to the atmosphere when the valve is deactuated, allowing the respective actuator cylinders 68 and 70 to freely retract.

On the other hand, when one or more of the air valves such as the air valve 80 are activated by the controller by applying a signal such as a 24 volt DC voltage to electrical leads 88, air pressure from the air manifold 58 flows through the tubes 72 and 84 to actuate the exemplary pneumatic actuator 70, forcing a tube pinch off member 84 against the tube flexible portion 64, closing off the flow of dye therethrough.

With reference now to FIGS. 6–9 the construction and operation of a representative pinch tube valve assembly will now be described in greater detail. It will be appreciated from the previous discussion herein, that an effective arrangement for rapid and precise control of dye flow is a crucial element of any apparatus for the pattern jet dyeing of textile material. The operational characteristics, reliability, and ease of maintenance of the dye control arrangement are fundamental considerations for commercial success.

Figure 7:
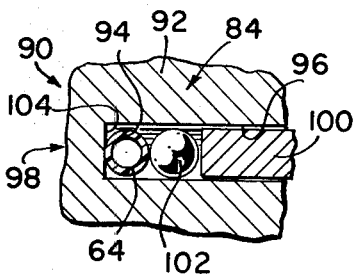
FIG. 7 is a sectional view taken along line 7—7 of FIG. 6.
Figure 9:
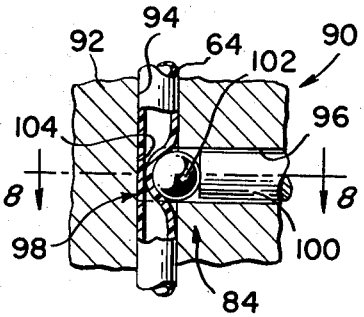
FIG. 9 is a sectional view, similar to that of FIG. 6, but on an enlarged scale, taken along line 9—9 of FIG. 8.
Figure 6:
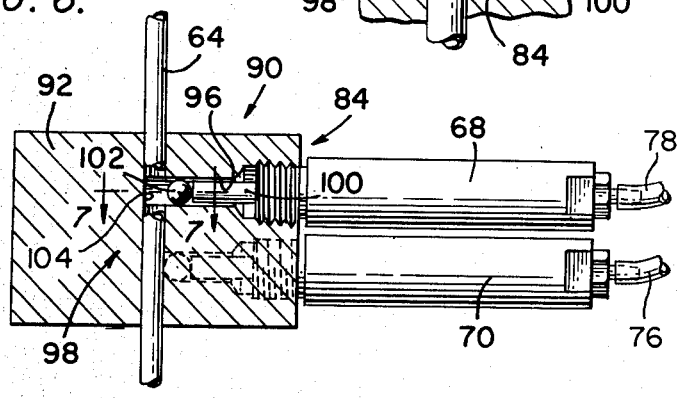
FIG. 6 is a sectional view taken along line 6—6 of FIG. 3 showing the internal construction of one form of pinch tube valve assembly in the tube open position, with a portion of the flexible tubing broken away to show underlying valve block details.
Figure 8:
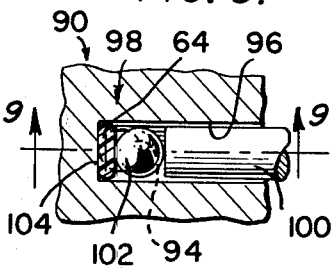
FIG. 8 is a sectional view similar to that of FIG. 7, but wherein the pinch tube valve assembly is in an actuated position to pinch off the dye delivery tube.

As noted above, the representative pinch tube valve assembly is of the type which selectively pinches closed the flexible portion 64 of the dye delivery tube. The valve open configuration is depicted in FIGS. 6 and 7, while the valve closed configuration is depicted in FIGS. 8 and 9.

The representative valve assembly 90 includes a valve block portion 92 with a bore 94 through the valve block portion 92 receiving the corresponding dye delivery tube flexible portion 64. It will be appreciated that the precise arrangement of the valve assemblies within the valve block portion 92 is not critical, and the valve block portions of a plurality or even all of the valves of a particular applicator such as the applicator 20 may be machined from a single metal bar.

The valve block 92 additionally includes a passageway 96 communicating with and disposed generally transversely to the bore 94, the intersection of the bore 94 and the passageway 96 defining and comprising a pinch chamber 98. The tube pinch off member 84 is selectively reciprocal within the passageway 96 into the bore 94 for forcing the corresponding dye delivery tube 64 closed. As may be seen from FIGS. 6–9, the tube pinch off member 84 preferably comprises a piston rod 100 and a freely floating ball 102 disposed between the end of the piston rod 100 and the corresponding dye delivery tube flexible portion 64.

An important aspect of the pinch tube valve assembly is that the bottom wall 104 of the bore 94 and thus of the pinch chamber 98 directly opposite the tube pinch off member 84 is flattened. This flattened portion 104 together with the freely floating ball 102 have been found to provide unusually good tube pinch off control characteristics. Additionally, the diameter of the passageway 96 which receives the piston rod 100 and ball 102 is slightly greater than the diameter of the bore 94 which receives the tube flexible portion 64. As noted above, flow control is both rapid and precise, with no dripping. Moreover, relatively little force from the tube pinch off member 84 is required to pinch the flexible tube portion 84 closed, with the result that literally millions of successive and successful repeated actuations of the same valve have been recorded during testing without failure. With this particular valve arrangement, the possibility of tube failure can be even further minimized by periodically, for example during scheduled maintenance periods, slightly longitudinally moving the tube flexible portion 64 within the bore 94, thereby to vary the precise point of tube compression.

The configuration of the representative pinch tube valve assembly 90 may be better understood from a description of how it may be manufactured. Starting with the solid valve block portion, the bore 94 is formed with an ordinary circular drill extending all the way through the valve block portion 92. A suitable diameter for the bore 94 is 9/64 inch. Next, the passageway 96 is formed by drilling at right angles to the bore 96, and suitably machining threads as at 106 for receiving the pneumatic actuator 68. A representative diameter for the passageway 96 is 13/64 in. Next, the flattened bottom wall 104 is formed using a flat nose drill or a bottom boring tool.

After the valve block 92 is thus machined, the remaining elements are assembled thereto. The tube flexible portion 94 is preferably ⅛ inch outside diameter urethane tube which, as may be seen from FIG. 2, is continuous from the dye manifold 50 to the nozzle tube 44. The 13/64 inch passageway 96 then receives a 3/16 inch diameter ball 102 and a 3/16 inch diameter piston rod 100, completing the valve assembly.

The somewhat surprising performance of the present valve is believed to be due to several of its constructional aspects. For reasons not fully explainable, the combination of the flattened portion 104 together with the freely-floating ball 102 are important aspects, together with the larger diameter for the communicating passageway 96 which receives the piston 100 and ball 102 compared to the diameter of the bore 94 which receives the flexible tube portion 64. It is believed, however, that the larger diameter of the passageway 96, which increases the size of the pinch chamber 98, provides sufficient space for the tube 64 to expand laterally as it is compressed (FIG. 8) avoiding crimping on the sides and tiny longitudinal passageways which might otherwise remain if the tube 64 were forced to compress in a pinch chamber which was too small. Thus, the pinch chamber 98 may also be termed a tube expansion chamber. Additionally, the ball 102 is believed to provide self-centering characteristics, and thus allows a self-aligning action within the flat bottomed chamber 98.

Referring now to FIG. 10, one form of controller 106 suitable for operating the applicator 20 of FIGs. 1–5, and more particularly the valves such as the valves 80 and 82 thereof, is shown in highly schematic form. Although the controller 106 operates on a photoelectric principle, it will be appreciated that suitable controllers will take various forms such as electrically or optically sensed rotating drums or endless webs, coded punch card, coded magnetic tapes, coded magnetic discs, and various forms of computer based controllers employing either or both of mass storage (e.g., magnetic tape or disc) and high speed random access memories. Those skilled in the art will recognize that the controller 106 of FIG. 10 is similar in concept to controllers conventionally employed for pattern carpet tufting machines. It will further be appreciated that, where a multicolored pattern is involved, whatever controller is selected must provide properly co-ordinated outputs for the individual applicators, taking into account the spacing between applicators. With the general type of controller illustrated in FIG. 10, this may be accomplished by providing a plurality of controllers such as the controller 106, suitably synchronized with one another.

More specifically, the FIG. 10 controller 106 comprises an endless, generally light transmissive web 108 carried by suitable rotating rollers 110 and 112. Representative pattern information is recorded on the web 108 in the form of an opaque area 114 which will ultimately result in a repeating series of substantially identically shaped, but greatly enlarged, dyed areas on the carpet being printed. Within the upper roller 110 is a tubular light source 116. To photoelectrically sense the pattern information, an array 118 of photoelectric elements 120 is provided, together with a fiber optic array 122 to transmit the light signals. The photoelectric elements 120 each comprise a suitable sensor (not shown), such as a phototransistor, and suitable electronic interfacing circuitry. The photoelectric elements 120 serve to output signals on corresponding output lines 124 when light supplied thereto is blocked by the opaque pattern area 144. It will be appreciated that the lines 124 are connected either directly or indirectly to individual dye control valves.

The fiber optic array 122 permits relatively close spacing (e.g., 0.01 inch) of individual pattern elements, while allowing wider spacing as a practical matter between much larger photoelectric elements 120. A relatively miniaturized controller 106 can thus be provided. For example, with 360 control points per applicator, the web 108 need be only just slightly in excess of 3.6 inches wide.

Figure 11:
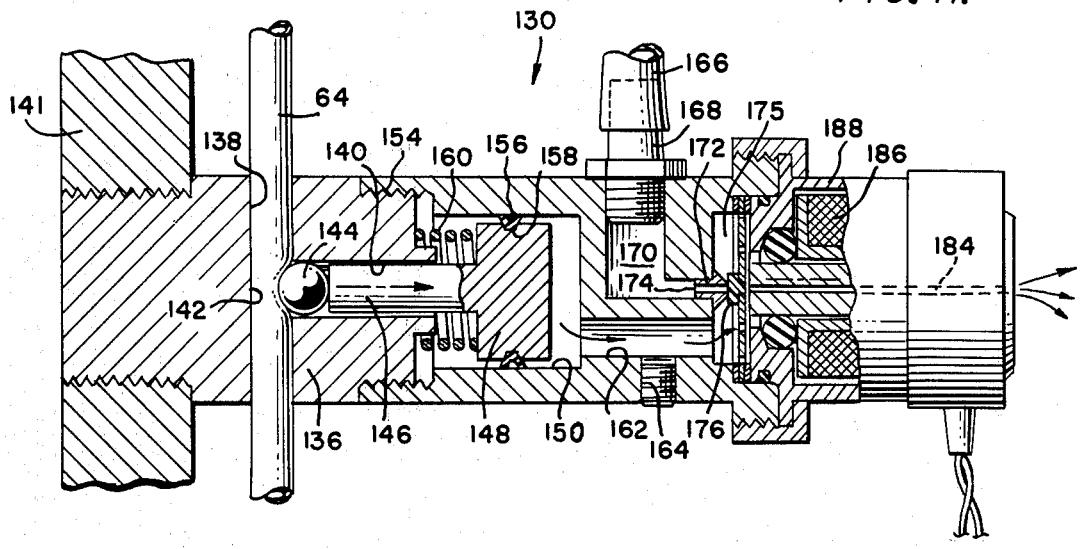
FIG. 11 is a cross sectional view of another form of pinch tube valve assembly wherein the pneumatically actuated piston as well as a valve controlled by the controller to selectively supply gas under pressure to actuate the piston is included in a single unit.
Figure 12:
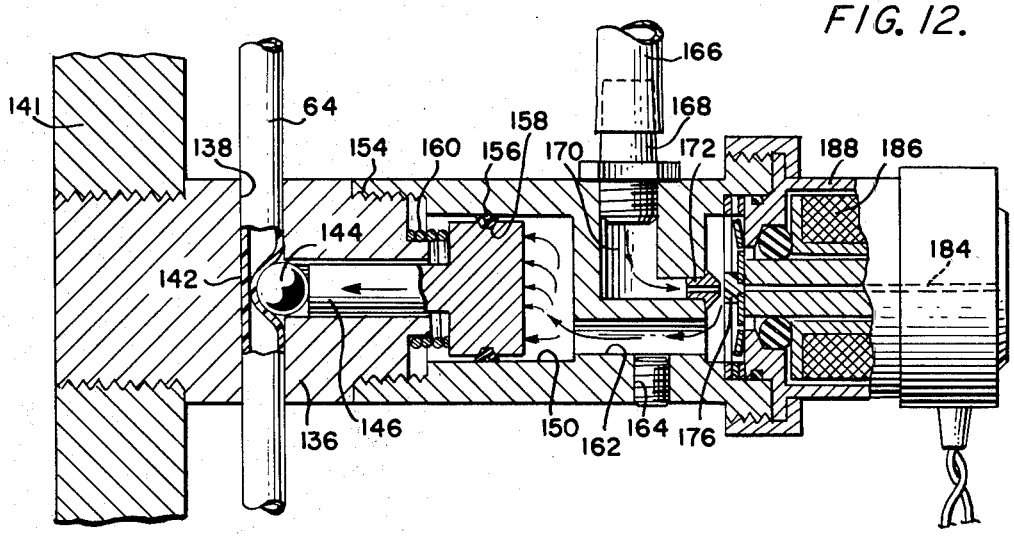
FIG. 12 illustrates the valve of FIG. 11 in the actuated position wherein the flexible tube portion is pinched closed.
Figure 13:
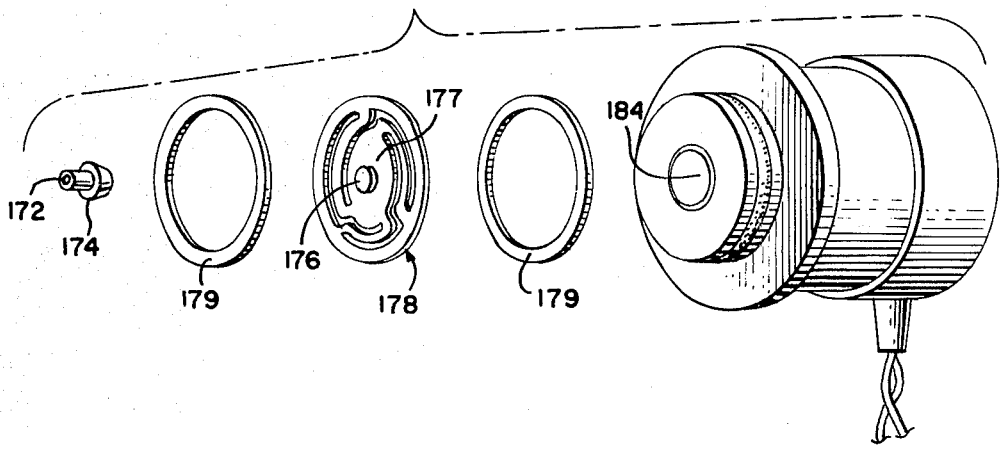
FIG. 13 is an exploded isometric view of a portion of the electrically actuated gas valve of the valve arrangement of FIGS. 11 and 12.

Referring now to FIGS. 11, 12 and 13, there is shown an alternative valve construction 130, FIG. 11 depicting the valve 130 open condition wherein dye freely flows, and FIG. 12 depicting the valve 130 closed position wherein the dye delivery tube flexible portion 64 is closed off. The valve 130 of FIGS. 11–13 is functionally identical to the previously-described valve arrangement, but differs in that a single assembly includes a pneumatic actuator 132 corresponding to the actuator 68 or 70 of FIG. 2, and an electromagnetically actuated valve portion 134 corresponding to the valve 80 or 82 of FIG. 2.

The valve 130 includes a tube receiving portion 136 which is machined in the same manner as the valve block portion 92 of FIGS. 6–9, and which includes a bore 138 and a communicating passageway 140 at right angles thereto. The tube receiving portion 136 is mounted by means of threads to a support member 141. As in the previously-described embodiment, a flattened portion 142 is formed in the wall of the bore 138 opposite the passageway 140. The passage 140 receives a ball 144 which actually bears against the tube flexible portion 64. A piston rod 146 actuated by a pneumatic piston 148 bears against the ball 144.

The piston 148 reciprocates within a cylindrical chamber 150 formed in an intermediate portion 152 screw threaded as at 154 to mate with the tube receiving portion 136. An annular seal 156 received in an annular groove 158 of the piston 148 bears against the walls of the cylindrical chamber 150, and a compression spring 160 is provided to urge the piston 148 and piston rod 146 towards the tube open position illustrated in FIG. 11.

The right-hand end of the intermediate portion 152 includes a passageway 162 for introducing air into and exhausting air from the cylindrical chamber 152 for actuation of the piston 148. A plugged bore 164 communicates with the passageway 162 for selectively controlled venting for valve modulation effects if desired.

The electromagnetic valve portion 134 of the valve 130 may be identical to that disclosed in the above-mentioned Clippard, Jr. et al U.S. Pat. No. 3,921,670, to which reference may be had for further details. The valve portion 134 functions when actuated (FIG. 12) to permit compressed air supplied through a tube 166 and fitting 168 into a passageway 170 terminating at a small diameter bore 172 in the end of a truncated insert member 174 communicating with a chamber 175. Air in the chamber 175 is then introduced through the passageway 162 to act against the piston 168, forcing the flexible tube portion 64 closed. In the valve deactuated position as illustrated in FIG. 11, the small diameter bore 172 is closed off by an elastomeric button 176 carried in the central portion 177 of a spider-like spring member 178, best seen in FIG. 13. Spacer rings 179 serve to axially position the spider member 178. In the FIG. 11 valve deactuated position, the cylindrical chamber 150 is vented through the passageway 162 and the chamber 175 and through a passageway 184 to the atmosphere. This permits the piston 168 to retract to the position of FIG. 11.

The spider member central portion 177 serves as an armature selectively operated by a twenty-four volt DC electromagnetic coil 186 including suitable ferromagnetic structure 188. When the coil 186 is energized, the spider armature 177 is pulled radially away from the small passageway 172 permitting compressed air introduced via the tube 166 to ultimately act on the piston 148. This also causes the elastomeric button 176 to seal off the vent passageway 184. When the electromagnetic coil 186 is not energized, resilience of the spider member 178 urges the elastomeric button 176 against the small diameter passageway 172 closing off the flow of incoming compressed air, and at the same time opening the chamber 175 to the vent passageway 184.

Figure 14:
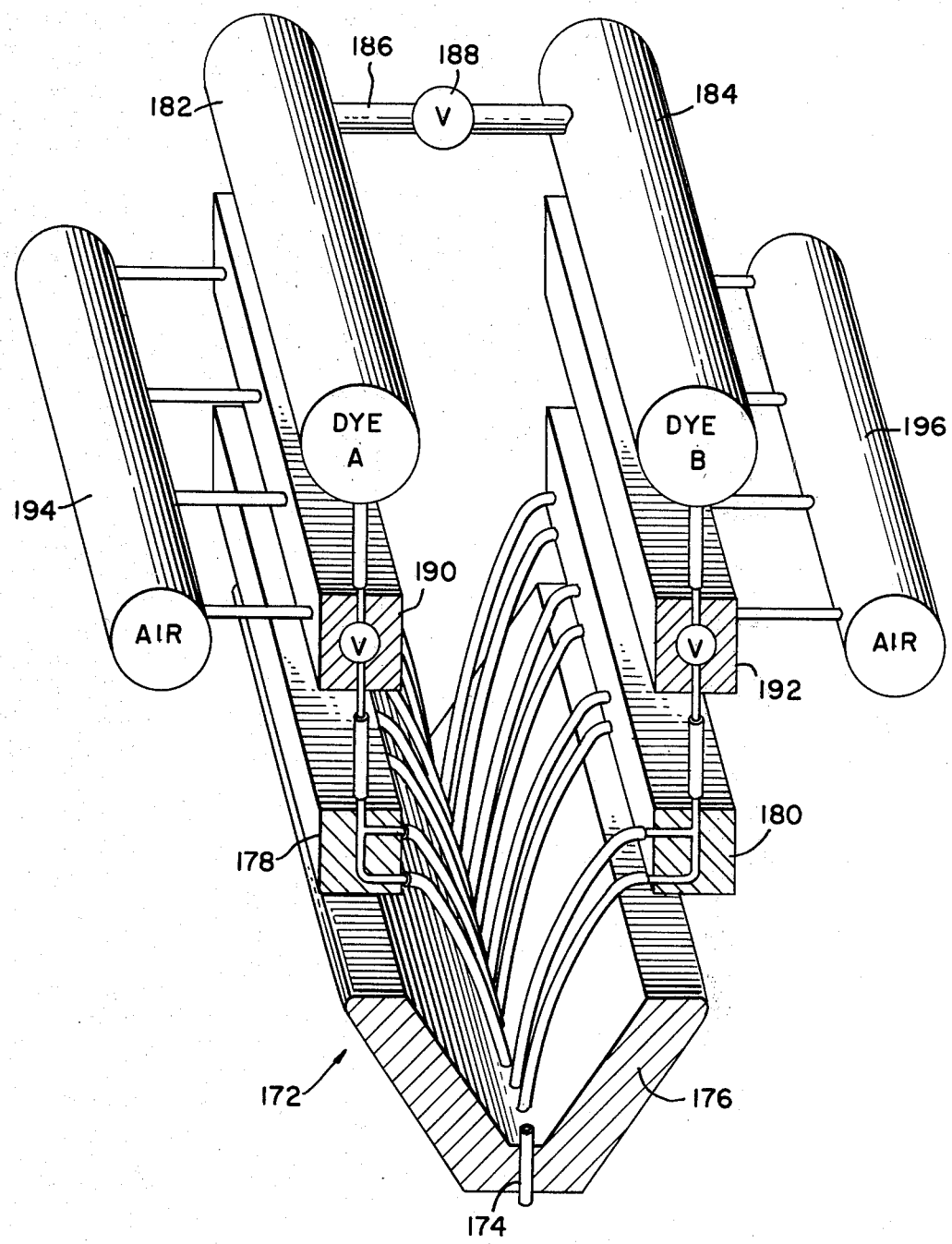
FIG. 14 is a highly schematic isometric view of another applicator arrangement according to the invention wherein all of the dye delivery nozzles are arranged in a straight line with no offset staggering, a plurality of different dyes are delivered by means of a single applicator, and adjacent dye nozzles are controlled in pairs.

Referring now to FIG. 14, an applicator configuration 172 which is an alternative to the applicator 20 depicted in FIGS. 1–4 is illustrated in highly schematic form. To illustrate various forms which the pattern dyeing apparatus in accordance with the present invention may take, the applicator 172 of FIG. 14 differs from those previously described in several respects.

One difference is that dye nozzle tubes 174 are arranged linearly on 0.10 inch centers. The individual nozzle tubes 174 may be of any suitable diameter consistent with the 0.10 inch spacing. For example, the nozzle tubes 174 may be formed of stainless steel tubing having an inside diameter of 0.042 inch and an outside diameter of 0.056 inch. A nozzle tube support 176 comprises a suitably machined generally "V" shaped block, having tube receiving bores drilled on 0.10 inch centers along the bottom thereof.

A second difference in the applicator of 172 is that while the dye nozzle tubes are on 0.10 inch spacing, the applicator provides a pattern resolution of only 0.20 inch, which has been found to be entirely sufficient as a practical matter, and permits halving the number of controlled valves. To permit this common supply of two dye nozzle tubes from a single valve controlled source, a plurality of individual "Y" branch manifolds are provided, such as the representative "Y" branch manifolds 178 and 180. While the number of pattern repeats across the width of the carpet being dyed is completely a matter of choice, it will be appreciated that by pairing up adjacent dye delivery tubes for common control, as well as constructing the applicator to automatically provide a fixed number of repeats across the width of a carpet, the number of controlled valves per applicator may be substantially reduced, reducing both the expense of the overall apparatus, as well as the controller complexity required. By way of example, a twelve foot applicator with full individual control and 0.10 inch resolution would require 1,440 individual control valves per applicator. However, by accepting two pattern repeats across the carpet (six foot repeat) and accepting 0.20 inch pattern resolution, the number of individual valve controls per applicator can be reduced to 360. Various such arrangements can readily be implemented through suitable routing of flexible tubing and provision of suitable branch members, such as the "Y" branch members 178 and 180, having the required number of outlets. In view of the high speed of operation, in order to avoid loss of synchronization between control of individual nozzles, the overall length of tubing for each of the individual dye delivery outlet tubes 174 of the applicator 172, measured from the outlet of the associated pinch tube valve and nozzle tube, must be essentially equal for each dye delivery tube of the applicator.

A third difference of the FIG. 14 embodiment is illustrated by the provision of a pair of dye manifolds 182 and 184 which may, when desired, be supplied with dyes of different characteristics, such as different colors, different pressures, different viscosities and thus penetration ability, or any combination. For added flexibility in the operation of the machine to achieve different pattern effects, a bypass conduit 186 having a valve 188 extends between the dye manifolds 182 and 184.

Each of the dye manifolds 182 and 184 supplies its corresponding "Y" branch manifold 178 or 180 through a corresponding set 190 or 192 of pinch tube valve assemblies, which are illustrated in highly schematic form. For example, each of the sets 190 and 192 of pinch tube valve assemblies may comprise a plurality of valves such as the valve 110 described above with reference to FIGS. 11 and 12. Lastly, a pair of air manifolds 194 and 196 supply operating air pressure to the valves. The required electrical connections to the valves are not shown in FIG. 14.

The operation of the applicator 172 of FIG. 14 is basically substantially identical to those previously-described, with the exception that dye interleaving effects are possible, due to the ability to apply dyes of different characteristics to closely adjacent points on the carpeting, to produce pattern effects previously unknown. It will be appreciated, however, that the dye manifolds 182 and 184 may be supplied with identical dye solutions to effect single color pattern dyeing from each applicator, in the manner known in the art.

From the foregoing, it will be appreciated that there has been provided an improved liquid dye jet pattern dyeing apparatus, particularly for textile material. The success of the inventive actuator depends in large part on the particular approach to valving taken, specifically a pinch tube valve assembly providing extremely precise and rapid control characteristics.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. Apparatus for pattern dyeing a continuously moving carpet web comprising means for conveying the carpet continuously along a substantially horizontal path past a dye applicator station;

at least one dye applicator at said station positioned above the path of said carpet web and extending across the width of the carpet web transverse to the direction movement of the carpet web;

each applicator including at least one dye manifold adapted to be maintained under pressure and at least one air manifold adapted to be maintained under a pressure, a plurality of dye delivery tubes, each tube having an inlet end and an outlet end and at least a portion thereof which is flexible so as to permit pinching of the flexible portion, a pinch tube valve assembly receiving each of said flexible portions for selective control of dye flow through the tube, each of said delivery tubes having its inlet end connected to a dye manifold and its outlet end supported above the path of the carpet web and adjacent thereto;

said valve assembly comprising a valve block having a bore extending through said block for receiving the flexible portion of the associated tube, a passageway in said block, said passageway intersecting with said bore at a right angle thereto, the intersection of said bore and said passageway defining a pinch chamber, an electrically operated pneumatic valve connected to an air manifold, an intermediate block portion member supported at one end to said valve block and supporting at its other end said pneumatic valve, an air chamber formed between said other end of said intermediate block portion and the pneumatic valve, said intermediate block portion including a central chamber communicating with said air chamber, piston means within said central chamber having a rod section at one end selectively reciprocal in said passageway between a first position and a second position, a freely floating ball disposed in said passageway between one end of the rod section and the flexible portion of the associated tube for pinching the flexible tube into a closed condition in response to actuation of said pneumatic valve and positioning of said rod section in its second position, said pinch chamber having a flattened wall portion circular in shape and being formed in said bore opposite the intersecting passageway and said flattened wall portion being in a plane perpendicular to said intersecting passageway so as to allow expansion of said tube upon pinching thereof; and controller means for selective actuation of the pinch tube valve assembly as the carpet web is conveyed past the applicator station to effect dyeing of the carpet web in the desired pattern.

2. A valve assembly according to claim 1, wherein said piston means comprises a cylindrical head section formed at the other end of said rod section and positioned for reciprocal movement within said central chamber, and spring means within said central chamber disposed about said rod section and having one end positioned against the end of the valve body to which the intermediate member is supported and its other end positioned to bear against the head section of the piston means to urge piston means to its first position.

3. A valve assembly according to claim 2, wherein said cylindrical head section includes an annular seal disposed to be in sealing engagement with the inner wall of said central chamber.

4. A valve assembly according to claim 3, further comprising an air input passage in said valve communicating with said central chamber through said electrically operated pneumatic valve for selectively supplying gas under pressure to activate said piston means for pinching closed the flexible tube.

5. A valve assembly according to claim 4, wherein said intermediate member includes an air input passage terminating in a small diameter bore for communicating with said air chamber and further including an insert control member positioned in said bore and having a central open passage therein and said pneumatic valve includes an elastomeric button adapted to be positioned to close off the open passage of the central member in response to actuation of said valve.

6. A valve assembly according to claim 5, wherein said button is centrally disposed in a spring spider member.

7. Pattern dyeing apparatus as set forth in claim 2, wherein said spring means within said central chamber is arranged to maintain said rod section in its first position which said pneumatic valve is deenerigized; and an air passage is provided in said intermediate member opening at one end into said air chamber and at its other end to said central chamber.

8. Pattern dyeing apparatus according to claim 1, wherein the dye delivery tube outlet ends are fixedly supported in a linearly-extending group of bores of a supporting block extending across the carpet web.

9. Pattern dyeing apparatus according the claim 1, including a plurality of applicators at said station spaced along the direction of travel of said carpet web, each said dye applicator being supplied with a different dye such that the pattern is multicolor design.

10. Pattern dyeing apparatus according to claim 1, wherein said dye manifold is maintained at a pressure between twenty and sixty psi.

11. Pattern dyeing apparatus according to claim 1, wherein said the outlet ends of said tubes are grouped in pairs, each pair being connected to the flexible portion of a dye delivery tube by a Y branch connector whereby each valve assembly controls the simultaneous application of dye through two outlet ends.

12. Pattern dyeing apparatus according to claim 1, wherein the outlet ends of the tubes are staggered in the direction of travel of the carpet web for increasing the effective density of outlet ends across the width of the web.

13. Pattern dyeing apparatus according to claim 12, wherein said outlet ends are arranged in two rows, each row having its outlet ends arranged on centers which are twice the effective outlet end spacing.

14. Pattern dyeing apparatus according to claim 13, wherein the outlet ends of one row are positioned between the outlet ends of the other row in the direction of travel of the carpet web.

15. Pattern dyeing apparatus according to claim 1, including means for synchronizing the actuation of the pinch tube valve assembly in response to the speed of the conveyed web.

16. Pattern dyeing apparatus according to claim 1, wherein said dye manifold includes means for circulating the dye therein.

17. Pattern dyeing apparatus according to claim 1, 9 or 11, wherein the overall length to tubing for each delivery tube between the outlet end and the flexible portion is essentially equal.

18. Pattern dyeing apparatus as set forth in claim 1, wherein the bore of said valve block and said passageway are circular in cross section and the diameter of said passageway is greater than that of the bore and said flattened wall portion having a diameter the same as said passageway.

19. Pattern dyeing apparatus as set forth in claim 1, wherein said applicator comprises a first and a second dye manifold, a first and a second air manifold, first selected pinch tube valve assemblies being connected to said first dye manifold and said first air manifold, second selected pinch tube valve assemblies being connected to said second dye manifold and said second air manifold, said outlet ends of the delivery tubes being grouped in pairs, along a common plane transverse to said web alternate grouped pairs being connected to said first dye manifold, the other grouped pairs being connected to said second manifold.

20. Pattern dyeing apparatus as set forth in claim 19, wherein each said grouped pairs of outlet ends are connected to single associated pinch tube valve assembly through a Y branch tubing connector.

21. Pattern dyeing apparatus as set forth in claim 19, further including an outlet end support extending across the moving web for rigidly supporting the outlet ends, said support having a through bore for each outlet end and the overall length of the tubing between the outlet end and the associated flexible portion being essentially equal.

* * * * *